United States Patent [19]

Buchtel

[11] Patent Number: 4,467,493

[45] Date of Patent: Aug. 28, 1984

[54] LATCHING ARRANGEMENT FOR A FLOOR CARE APPLIANCE WITH MOUNTED ACCESSORY APPLIANCE

[75] Inventor: Dean H. Buchtel, Canton, Ohio

[73] Assignee: The Hoover Company, North Canton, Ohio

[21] Appl. No.: 418,731

[22] Filed: Sep. 16, 1982

[51] Int. Cl.[3] ..... A47L 9/00

[52] U.S. Cl. ..... 15/323; 15/339; 15/410

[58] Field of Search ..... 15/323, 410, 336, 339, 15/328

[56] References Cited

U.S. PATENT DOCUMENTS

| | | | |
|---|---|---|---|
| 1,756,519 | 4/1930 | Moore | 15/328 |
| 2,673,366 | 3/1954 | Johnson | 15/323 X |
| 2,825,086 | 3/1958 | Tamarin | 15/323 |
| 2,842,788 | 7/1958 | Rench et al. | 15/410 X |
| 3,955,237 | 5/1976 | Chateauneuf et al. | 15/323 |
| 4,249,280 | 2/1981 | Goodrich | 15/323 |

*Primary Examiner*—Chris K. Moore
*Attorney, Agent, or Firm*—Gerald H. Kreske; Richardson B. Farley

[57] ABSTRACT

The invention is provided in a floor care appliance with a rigid housing having a pocket for nesting an accessory appliance. A latch means maintains the accessory appliance within the pocket and is releasable to permit removal of the accessory appliance. The latch means includes a catch, with the floor care appliance, movable into and out of engagement with an opposite locking portion of the accessory appliance.

6 Claims, 8 Drawing Figures

LATCHING ARRANGEMENT FOR A FLOOR CARE APPLIANCE WITH MOUNTED ACCESSORY APPLIANCE

BACKGROUND OF THE INVENTION

1. Field of Invention

This invention relates to floor care appliances and, more particularly, relates to a latching arrangement which may be used on an upright cleaner having a pouch or pocket for the storage of an accessory appliance.

2. Description of the Prior Art

Tool storage in canister cleaners either within or on the canister casing is old and well known. Storage of tools on the handles of upright cleaners or the like is also known. It is also known (Ser. No. 419,615) to provide an upright type floor care appliance having a nested accessory appliance mounted in a rigid housing of the floor care appliance.

Accordingly, it is an object of the invention to provide a locking arrangement for this configuration to insure securement between the accessory appliance and the upright floor care appliance.

It is an additional object of the invention to insure proper arrested nesting of an accessory appliance in an upright type floor care appliance.

It is a further object of the invention to provide new and novel locking linkage having general utility in the latching art.

SUMMARY OF THE INVENTION

The invention comprises an upright vacuum cleaner, floor care appliance or the like having a rigid housing in which is nested an accessory appliance. Specifically, the accessory appliance consists of a hand held cleaner which nests in a depression or pocket in an upwardly extending rigid housing disposed below the handle of a cleaner.

The pocket includes a front border portion behind the snout or lower portions of the accessory appliance rests and an outwardly opening shell like portion to receive upper reaches of the accessory appliance above the lower portions of it.

A latching arrangement securely mounts the accessory appliance within the depression. This latching arrangement takes the form of a rectilinearly moving latch catch which engages in a slot on the inner side of the accessory appliance to hold it firmly to the cleaner. The latch is resiliently urged to locking position and includes cam surfaces which move it to slightly disengaged position when locking of it occurs with the accessory appliance.

BRIEF DESCRIPTION OF THE DRAWINGS

Reference now may be had to the accompanying Drawings for a better understanding of the invention, both as to its organization and function, with the illustration being of a preferred and a secondary embodiment, but being only exemplary, and in which.

DETAILED DESCRIPTION OF THE INVENTION

Figure 1:
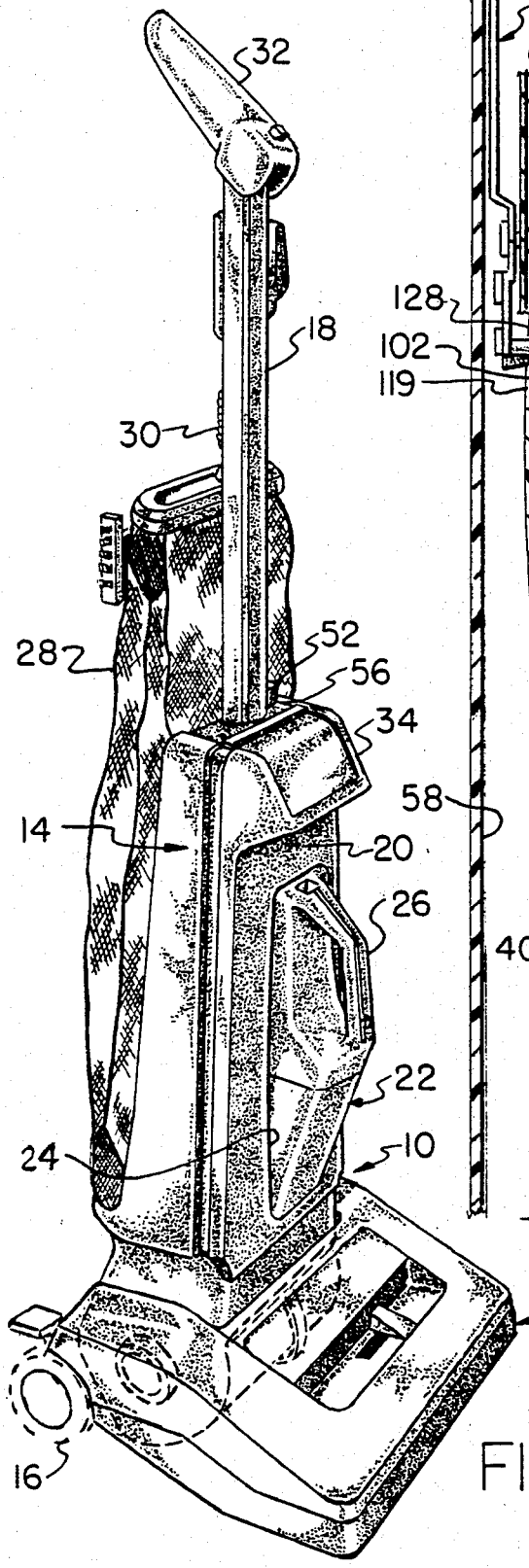
FIG. 1 is a perspective view of the preferred embodiment of the invention.

The invention (FIG. 1) comprehends a vacuum cleaner or floor care appliance 10 having a lower rigid housing 12 containing conventionally, the suction nozzle (not shown) and an upper, upwardly extending rigid housing 14, conventionally, pivotally attached to the lower rigid housing 12. The lower rigid housing includes wheels 16, while the upper rigid housing 14 is provided with a handle 18 extending upwardly from it.

Mounted within a front portion or cover 20 of the upper rigid housing 14 is an accessory cleaning appliance 22 which may ideally take the form of a hand held cleaner. Such a cleaner is generally disclosed in U.S. Pat. No. 4,421,964, Dec. 20, 1983 titled, "Remote Switch Actuator" and owned by a common assignee. Reference should be had to this application for a more particularized description of accessory appliance 22.

Accessory appliance 22 is lodged or nested in a pocket or depression 24 extending inwardly of the front portion or cover 20 of upper rigid housing 14 so that a portion of the accessory appliance 22 juts outwardly therefrom including a handle 26 of the accessory appliance 22.

The vacuum cleaner 10 also includes a bag 28 extending upwardly behind the upper rigid housing 14 and mounted at its upper end by a spring 30. A handgrip 32 is attached to the handle 26 at its upper end. A carrying handle 34 is also included in the upper rigid housing 14 in the front cover 20.

The accessory appliance 22 nests within the pocket or depression 24 and conforms closely to it because of the open shell like configuration of the pocket 24 which includes top wall 35, side walls 36 and 38 and back wall 40 which taper to conform to the taper of the accessory appliance 22 with the side walls 36 and 38 and back wall 40 curving inwardly at the thickest portion of the accessory appliance 22.

At the front, lower side of the pocket 24 is formed a thickened semi soft vinyl material portion 42 of the pocket 24 providing an upwardly opening generally V-shape 44 in which nests a snout 46 of the accessory appliance 22. A front portion 48 of thickened portion 42 is thereby formed to provide a wall obstructing the direct outward removal from the pocket 24 of the accessory appliance 22.

In order to maintain the accessory appliance 22 within the pocket 24 at its upper end, a plastic latching arrangement 50 is provided which engages with the accessory appliance 22. It includes a button 52 extending outwardly, for convenient operator access, from a top 56 of upper rigid housing 14.

The button 52 is guided through a hole 57 in top 56 and is integral with a long thrust link 54 that extends downwardly therefrom within the confines of the vacuum cleaner 10 as bordered by a back wall 58 of the cleaner 10.

The long thrust link 54 includes an offset 60, at its bottom, which is pivoted by a loose pivot 62, formed by an integral short shaft 67, to a generally horizontally extending thinner cross or swinging link 64, the offset 60 placing the outer sides thrust link 54 and cross link 64 in general alignment and permitting thrust link 54 to be thickened along most of its length. These two links are pivoted to an intermediate wall 66 extending downward from top 56 by a pivot 68. The pivot 68 of cross link 69 is formed by an integral connector button 70 having a series of wedges 74, 74 on its opposite split end. The "wedged" end of the connector button 70 is inserted through a bore 78 in wall 66 so that the one way wedges 74,74 captivate the connector 70 in the wall 66. The button 70 then turns with the link 64 through rotating surface 71.

Intermediate the ends of the cross link 64 is a latch carrying locking link 80 that depends downwardly. This link is loosely pivoted to cross link 64 by pivot 82 formed by a short stub shaft 84 on the upper end of link 80 inserted a bore 86 in cross link 64. The loose pivots 62 and 84 are maintained connected by the general alignment of the arrangement 50. Below the pivot 82, the latch carrying link 80 is stepped outwardly so that a track section 88 of it can form oppositely facing channels 90 and 92 which receive wall portions 94 and 96 of intermediate wall 66 therein. An aperture 98 in an offset 99 of intermediate wall 66 permits the downward insertion therein of latch carrying link 80.

Below the track section 88, the latch carrying link 80 includes a downwardly extending portion 100 which carries a latch catch 102 on its inner side utilized for locking purposes. On its outer side, link 80 is attached with a cross piece 104 which serves as a reinforcement and an abutment check, acting against the outer wall 58, if the link 80 is distorted outwardly.

The latching arrangement 50 is spring urged upwardly by a coil tension spring 106 having hooked ends 108 and 110 that connect, respectively, through an aperture 112 in intermediate wall 66 and an aperture 114 in cross link 64. The spring 106 lays partly in cutout 116 in intermediate wall 66. A stop 115, integral with intermediate wall 66 acts against spring 106 and limits upward movement of the latching arrangement 50. A stop 117, integral with intermediate wall 66 limits downward movement.

Figure 3:
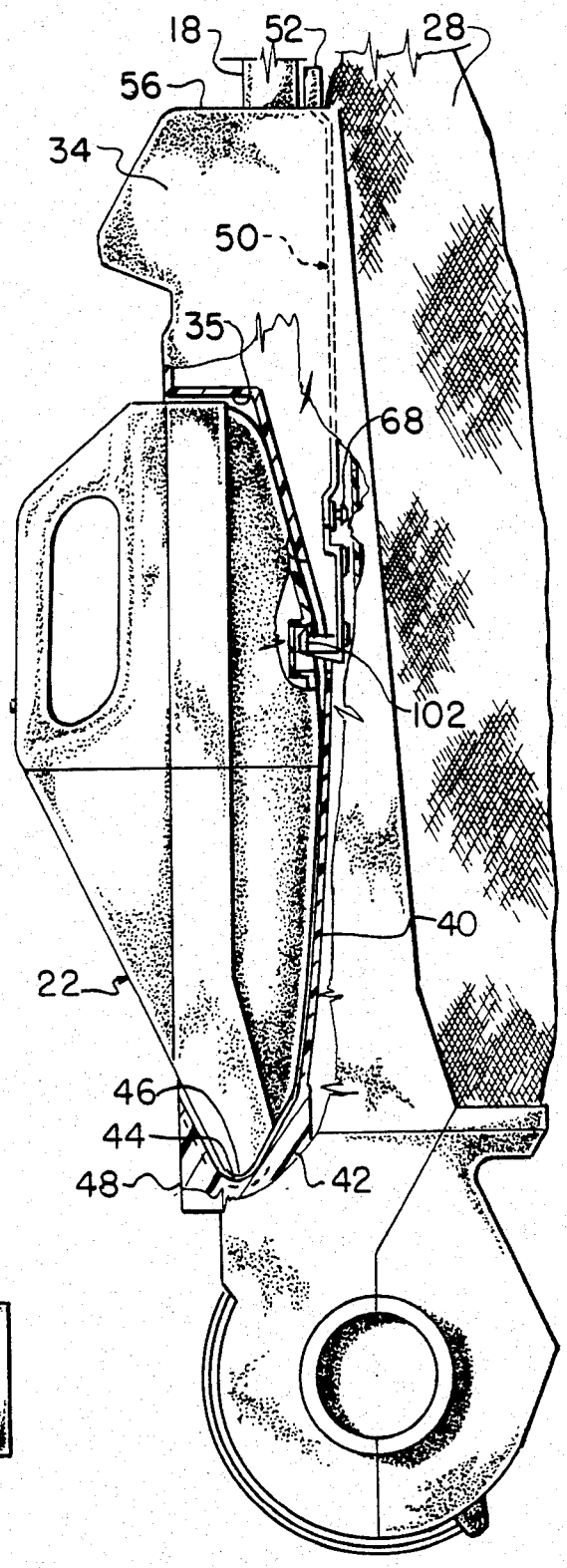
FIG. 3 is a side elevation view, partly in cross section, of the same rigid housing.
Figure 6:
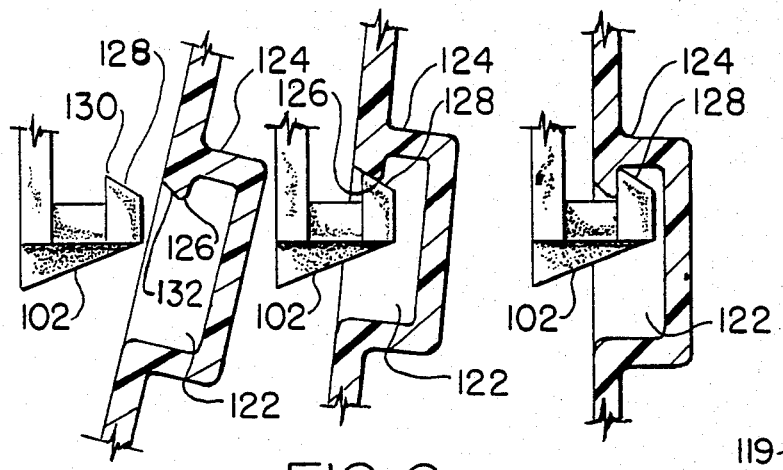
FIG. 6 is a somewhat schematic illustration of the catch of the latching arrangement of FIG. 4 in neatly engaged, engaged and disengaged position.

Latch catch 102 extends through a vertically extending slot 118 in intermediate wall 66 and then through a keyhole shaped or locking slot 119 in the back wall 40 of the pocket 24 (e.g. FIG. 3), formed by the front cover 20 of upper rigid housing 14 so as to be engageable with the accessory appliance 22. Disposed within accessory appliance 22 is a latching recess 122 which is tapered from its top to form, generally, a triangle with rounded points and with the apex uppermost. It includes at its top a latching lip or catch 126 that extends downwardly from the top and forms a ledge behind which latch catch 102 locks by means of a latch portion 128. The keyhole slot 119 is shaped to permit insertion of the enlarged nose 103 of latch catch 102 at its top so that the latch catch is situated to engage latching recess 122.

Figure 7:
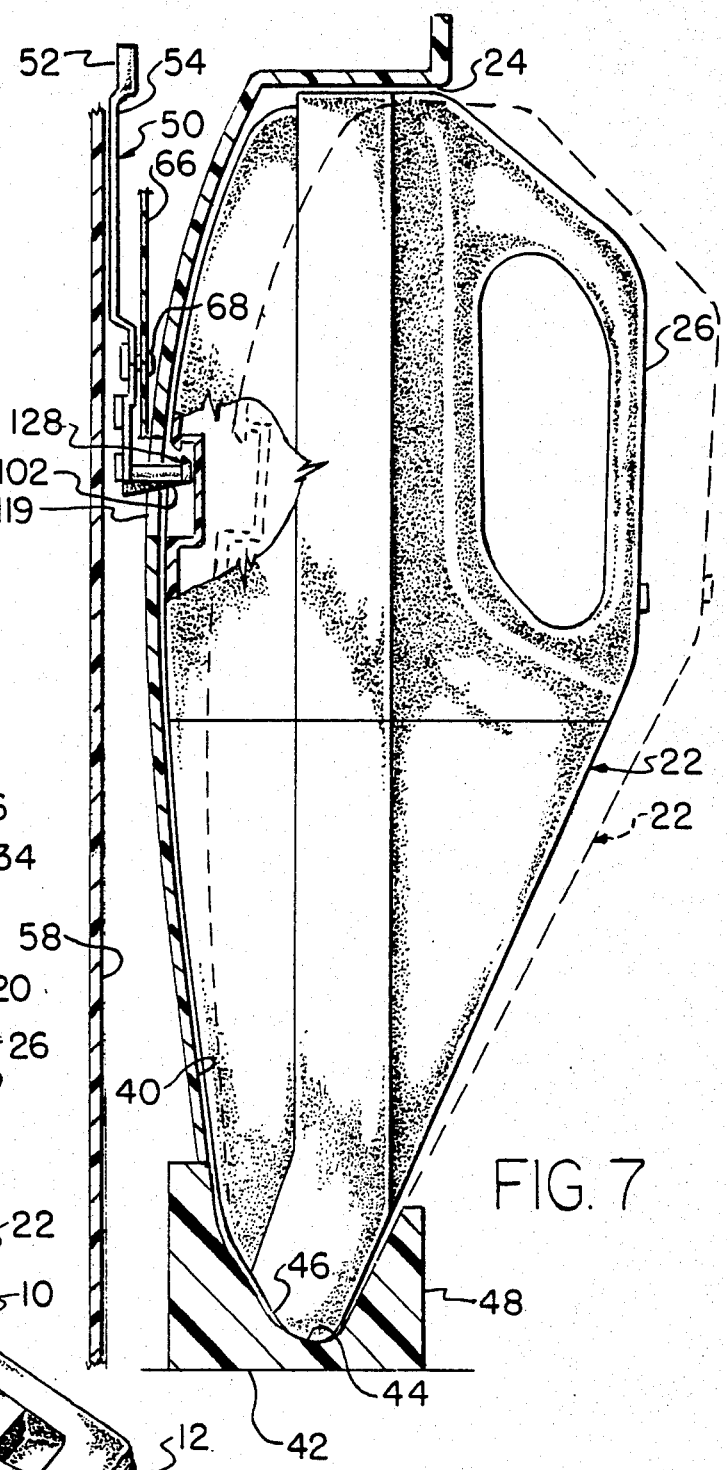
FIG. 7 is a generalized view, partly in cross section, of the accessory appliance of FIG. 1 in latched and unlatched position.
Figure 2:
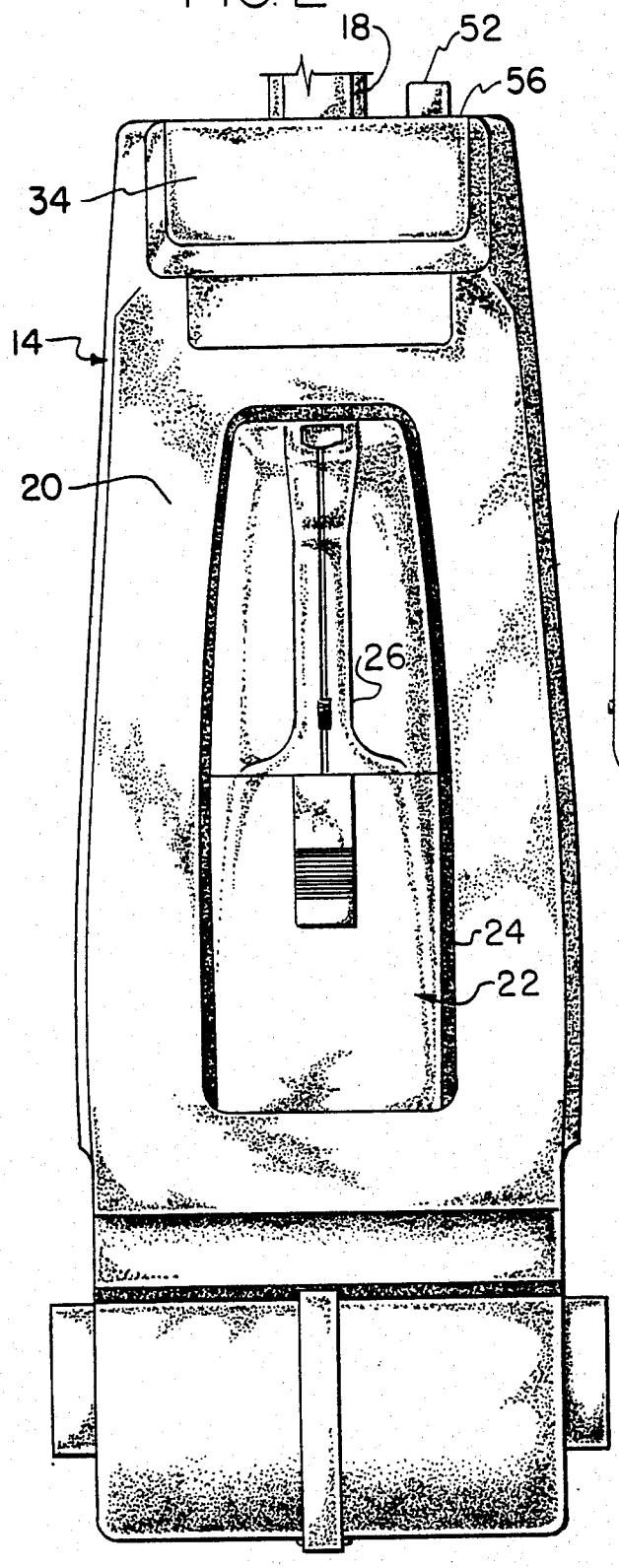
FIG. 2 is a front elevational view of the upper rigid housing of the preferred embodiment.
Figure 4:
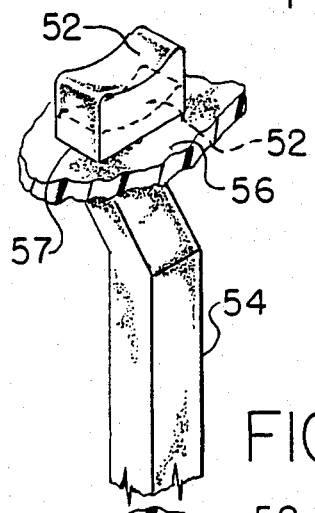
FIG. 4 is a perspective view, in latched and unlatched position, of the latching arrangement for the accessory appliance of FIG. 1.
Figure 8:
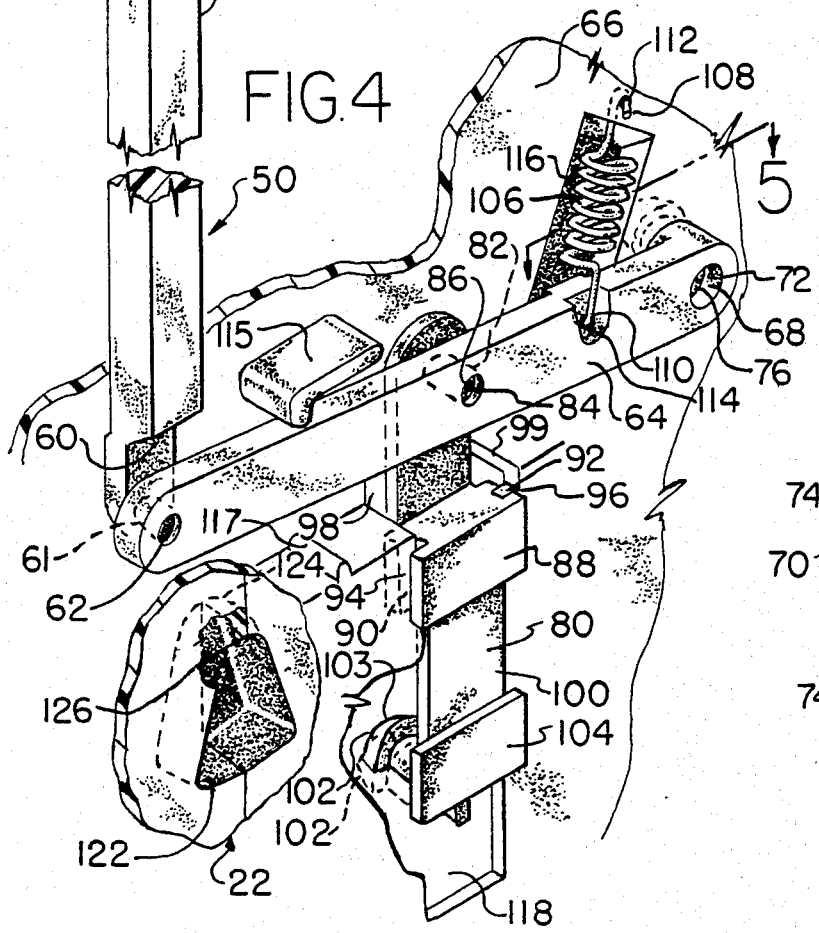
FIG. 8 is a fragmentary view of the rigid housing of FIG. 1 showing the accessory appliance pocket.
Figure 8:
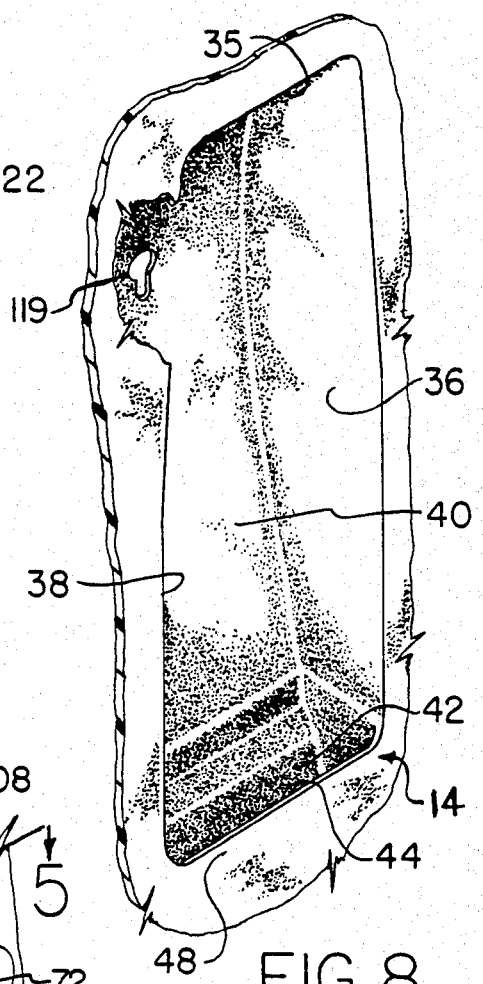
Figure 5:
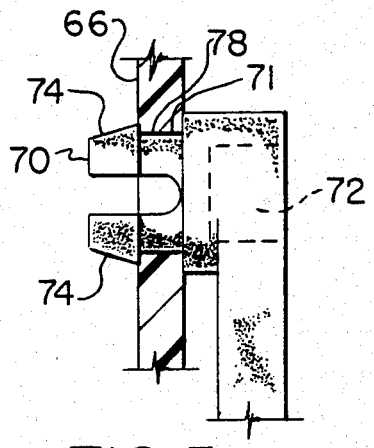
FIG. 5 is a view taken on line 5—5 of FIG. 4 and showing one end of the latching linkage with the spring removed.

The operation of the preferred embodiment should now be apparent. Assuming that the accessory appliance 22 is mounted in nested configuration with the cleaner 10, to release the accessory appliance the button 52 is depressed driving the latching arrangement 50 including the latch carrying link 80 downwardly (dashed position in FIG. 4). This moves the latch catch 102 downwardly (FIG. 7) clearing a latch portion 128 of it from the lip 126. The accessory appliance 22 is then tilted outwardly from its top (dashed position in FIG. 7) and then removed from the lower portion of the pocket 24 upwardly to free its snout 46.

What is claimed is:

1. A floor care appliance and accessory appliance including;
   (a) a latching arrangement for maintaining said accessory appliance with said floor care appliance;
   (b) said latching arrangement including a catch engageable in a linearly extending slot in said accessory appliance;
   (c) said catch moving linearly relative to the linear extent of said slot;
   (d) said latching arrangement including an operator -engageable linkage having a thrust link disposed adjacent to said catch and moving with said linkage to move said catch linearly relative to said slot;
   (e) said thrust link pivoted to a swinging link also forming a part of said latching arrangement, said swinging link swinging with said linkage to move said catch;
   (f) a spring attached to said linkage to urge against movement of said linkage in one direction of movement, and
   (g) a locking link attached to said swinging link and carrying said catch for movement of said catch linearly relative to said slot.

2. A floor care appliance and accessory appliance as set out in claim 1 wherein;
   (a) said locking link is guided by a track.

3. A floor care appliance and accessory appliance as set out in claim 1 wherein:
   (a) said linearly extending slot includes a lip, said catch engaging with said lip.

4. A floor care appliance and accessory appliance as set out in claim 3 wherein:
   (a) said catch includes a cam surface to enable movement of said lip to locking position.

5. A floor care appliance and accessory appliance as set out in claim 1 wherein:
   (a) said locking link moves along an axis and has said catch mounted therewith to extend through a wall of said floor care appliance transversely of said axis and perpendicular of the lateral extent of said locking link to engage said accessory appliance to lock said accessory appliance to said floor care appliance.

6. A floor care appliance and an accessory appliance including:
   (a) a latching arrangement for maintaining said accessory appliance with said floor care appliance;
   (b) said latching arrangement including a catch engageable in a linearly extending slot in said accessory appliance;
   (c) said catch moving linearly relative to the linear extent of said slot,
   (d) said latching arrangement including an operator engageable linkage having a thrust link disposed adjacent to said catch and moving with said linkage to move said catch linearly relative to said slot;
   (e) said thrust link pivoted to a swinging link also forming a part of said latching arrangement, said swinging link swinging with said linkage to move said catch; and
   (f) a locking link attached to said swinging link and carrying said catch for movement of said catch linearly relative to said slot.

* * * * *